US005377382A

United States Patent [19]

Bores et al.

[11] Patent Number: 5,377,382

[45] Date of Patent: Jan. 3, 1995

[54] FLOOR CLEANING MACHINE INCLUDING SQUEEGEE ASSEMBLY

[75] Inventors: Frederick M. Bores, Highlands Ranch; Thomas G. Plaven, Littleton, both of Colo.

[73] Assignee: Windsor Industries, Inc., Englewood, Colo.

[21] Appl. No.: 60,874

[22] Filed: May 13, 1993

[51] Int. Cl.[6] ..... A47L 11/30

[52] U.S. Cl. ..... 15/340.1; 15/245; 15/320; 15/401

[58] Field of Search ..... 15/320, 401, 245, 98, 15/304.1

[56] References Cited

U.S. PATENT DOCUMENTS

| | | | |
|---|---|---|---|
| 2,876,484 | 3/1959 | Wells | 15/401 X |
| 3,028,692 | 4/1962 | Brock | 37/42 |
| 3,065,490 | 11/1962 | Arones | 15/401 X |
| 3,376,597 | 4/1968 | Boyd | 15/401 X |
| 3,496,591 | 2/1970 | Sheler | 15/401 X |
| 3,550,181 | 12/1970 | Dolan et al. | 15/320 |
| 4,041,567 | 8/1977 | Burgoon | 15/320 |
| 4,075,730 | 2/1978 | Siemund | 15/245 |
| 4,173,056 | 11/1979 | Geyer | 15/320 |
| 4,293,971 | 10/1981 | Block | 15/401 X |
| 4,363,152 | 12/1982 | Karpanty | 15/98 |
| 4,429,433 | 2/1984 | Burgoon | 15/401 X |
| 4,492,002 | 1/1985 | Haldhauser et al. | 15/401 X |
| 4,765,015 | 8/1988 | Torta | 15/245 |
| 4,809,396 | 3/1989 | Houser | 15/401 X |
| 4,937,911 | 7/1990 | Picchietti, Sr. et al. | 15/320 |
| 5,239,720 | 8/1993 | Wood et al. | 15/401 X |

*Primary Examiner*—Chris K. Moore

*Attorney, Agent, or Firm*—Sheridan Ross & McIntosh

[57] ABSTRACT

A cleaning machine for cleaning floor surfaces is disclosed characterized by a squeegee blade assembly that utilizes a number of connectors for dual functions. The squeegee blade assembly includes a holding subassembly for maintaining the squeegee blades in place. A plurality of connectors are used to connect the squeegee blades to the squeegee holding subassembly. A first set of these connectors also connects the squeegee holding subassembly to a squeegee mounting assembly, which is attached to the body of the cleaning machine. A second set of these connectors is also used to connect rollers to the holding subassembly. A third set of these connectors also attaches a caster assembly to the holding subassembly. Each squeegee blade is an integral, one-piece member but with an upper section having a greater hardness than the lower section.

16 Claims, 3 Drawing Sheets

FLOOR CLEANING MACHINE INCLUDING SQUEEGEE ASSEMBLY

FIELD OF THE INVENTION

The present invention relates to a floor cleaning machine and, in particular, to a squeegee assembly used in wiping up liquid from a floor surface being cleaned.

BACKGROUND OF THE INVENTION

Cleaning machines utilize scrubbing units for cleaning floor surfaces. The scrubbing unit typically includes a number of brushes that are located at the front of the cleaning machine. After the cleaning step involving the scrubbing brushes, it is desirable to wipe up liquid that remains on the surface, as well as remove the imprint of cleaning machine wheel tracks. These operations are commonly performed by a squeegee assembly that is located at the back of the cleaning machine. The squeegee assembly can be raised and lowered relative to the body or main frame of the cleaning machine using a linking unit.

The squeegee assembly includes squeegee blades that engage the floor surface in a wiping action to assist in picking up liquid on the floor. It is common for the squeegee blades to wear out as a result of their use in wiping against the floor surface. It becomes necessary therefore to replace the blades that are used in picking up the liquid. In order to connect squeegee blades to a squeegee assembly, it is common to use a number of connectors that are disposed perpendicular to the lengths of the squeegee blades. In this configuration, a significant number of bolts or screws must be removed in order to replace the squeegee blade or blades. These connectors are in addition to fasteners that are required to connect other parts to the squeegee assembly. Furthermore, this connection arrangement can cause the length of the squeegee blade not to be straight or to be undulated when it is connected to the squeegee frame. This results in a less effective wiping action. Squeegee assembly designs have been advanced related to facilitating the removal of squeegee blades. Notwithstanding these efforts, it remains worthwhile to provide a squeegee assembly that overcomes drawbacks found in squeegee assembly designs, particularly related to the connection of squeegee blades.

SUMMARY OF THE INVENTION

In accordance with the present invention, a squeegee assembly is disclosed that is connected to a housing unit of a cleaning machine. The squeegee assembly is used in wiping up liquid that remains on a floor surface that is being cleaned. The squeegee assembly is connected to the housing unit by means of a squeegee mounting assembly in making the connection between the squeegee assembly and the squeegee mounting assembly, a plurality of mounting connectors are utilized. The mounting connectors are also employed in connecting squeegee blades to the remaining parts of the squeegee assembly. Additionally, roller connectors and caster connectors are used to provide dual connection functions.

More particularly, the squeegee assembly includes a holding subassembly that includes the plurality of connectors. The holding subassembly also comprises a first contacting shoe and a second contacting shoe. The two squeegee blades are held between the first and second contacting shoes. In that regard, each squeegee blade is characterized as having an upper section and a lower section. Each squeegee blade upper section is disposed between surfaces of the first and second contacting shoes, with the second contacting shoe being located inwardly of the first contacting shoe. The upper section of each squeegee blade is characterized by having a cross-section that is L-shaped. The first contacting shoe has a base plate and first and second legs that extend downwardly normal to the plane of the base plate along opposite edges thereof. The second contacting shoe has a center section with first and second arms extending downwardly in a direction normal to the center section along edges thereof. A horizontal member of the L-shaped configuration for each squeegee blade upper section is located between an inner surface of the base plate and an outer surface of the center section. The vertical member of the L-shaped upper section is disposed between an inner surface of a lea of the first contacting shoe and an outer surface of an arm of the second contacting shoe. Accordingly, a space is created between the base plate and the center section of the two contacting shoes, as well as between the arms and legs thereof, which space is occupied by squeegee blade portions.

The base plate of the first contacting shoe has a number of holes, with the number of holes corresponding to the number of aforesaid connectors for achieving the dual connection. The second contacting shoe has a number of bores formed therethrough. Each bore is aligned with one of the holes of the first contacting shoe. Each of the mounting connectors has a length that extends from the squeegee mounting assembly, which connects to the housing unit, through an aligned hole and bore. Tightening of the mounting connectors not only connects the squeegee assembly to the squeegee mounting assembly, but also causes the squeegee blades to be tightly held between the first contacting shoe and the second contacting shoe. Similarly, tightening of the roller connectors to attach the rollers to the holding subassembly also acts to hold the squeegee blades in place and tightening of the caster connectors to attach the caster assembly to the holding subassembly also acts to hold the squeegee blades in place. The rollers are used to contact wall surfaces so that other parts of the squeegee assembly do not contact them, while the caster assembly is necessary in order to pick up liquid while the cleaning machine is moving in a reverse direction.

With regard to squeegee blade connections, each connector causes a first compressive force to be applied in a direction substantially parallel to its length. This causes the horizontal member of the L-shaped squeegee blade upper section to be maintained in place and not be pulled from out between the first and second contacting shoes. Because there is some degree of flexibility in the vertical member of the squeegee blade upper section, as well as a desired dimensional relationship between the thickness of the vertical member and the spacing between the legs and arms of the contacting shoes, a second compressive force is also provided against the squeegee blade, when the first and second contacting shoes are joined together with the squeegee blade upper section located therebetween. In the absence, however, of the horizontal members of the squeegee blade upper sections, there would be a tendency and a likelihood that the squeegee blades would be pulled out when they are rubbing against a floor surface and being involved in picking up liquid therefrom.

In a preferred embodiment, each of the two squeegee blades is a single, integral one-piece member. However, at least a majority of the upper section of each blade has a hardness property that is different from the squeegee blade lower section resulting in a dual durometer blade. That is, the squeegee blade upper section is relatively harder, for example, being made of a shore A 90 material. The durometer value of the lower section of the squeegee blade is about less than half that of the upper section and is made of a shore A 40 material. The relatively harder upper section enables it to be better clamped or held by the holding subassembly while the less hard squeegee blade lower section allows it to have sufficient resiliency as it engages the floor surface in picking up liquid.

Based on the foregoing summary, a number of salient features of the present invention are readily identifiable. A squeegee assembly is provided for wiping up liquid having a design that reduces parts. Connectors are utilized for dual purposes. Mounting connectors that attach the squeegee assembly to the cleaning machine, by means of the squeegee mounting assembly, are also used to hold the squeegee blades in place. Roller connectors join rollers to the squeegee assembly and simultaneously act to maintain the squeegee blades in place. Caster connectors attach a caster assembly to the squeegee assembly, as well as connecting the squeegee blades to the holding subassembly. Relatedly, bolts or screws that were previously required to hold the squeegee blades in place are no longer necessary. Because there are relatively few connectors that are employed to achieve the dual function, removal and replacement of squeegee blades is facilitated. Each squeegee blade is held in place by relying on a L-shaped cross-sectional design in which a force in a direction parallel to the length of the connectors maintains the squeegee blade in place without being pulled from the holding assembly. Each squeegee blade is a one-piece construction, but parts thereof have different durometer values. The upper section of each squeegee blade has a greater hardness than the lower section to assist in achieving the tight connection between the squeegee blades and the holding subassembly, while the desired resiliency is maintained in the lower section of each squeegee blade.

Additional advantages of the present invention will become readily apparent from the following discussion, particularly when taken together with the accompanying drawings.

DETAILED DESCRIPTION

Figure 1:
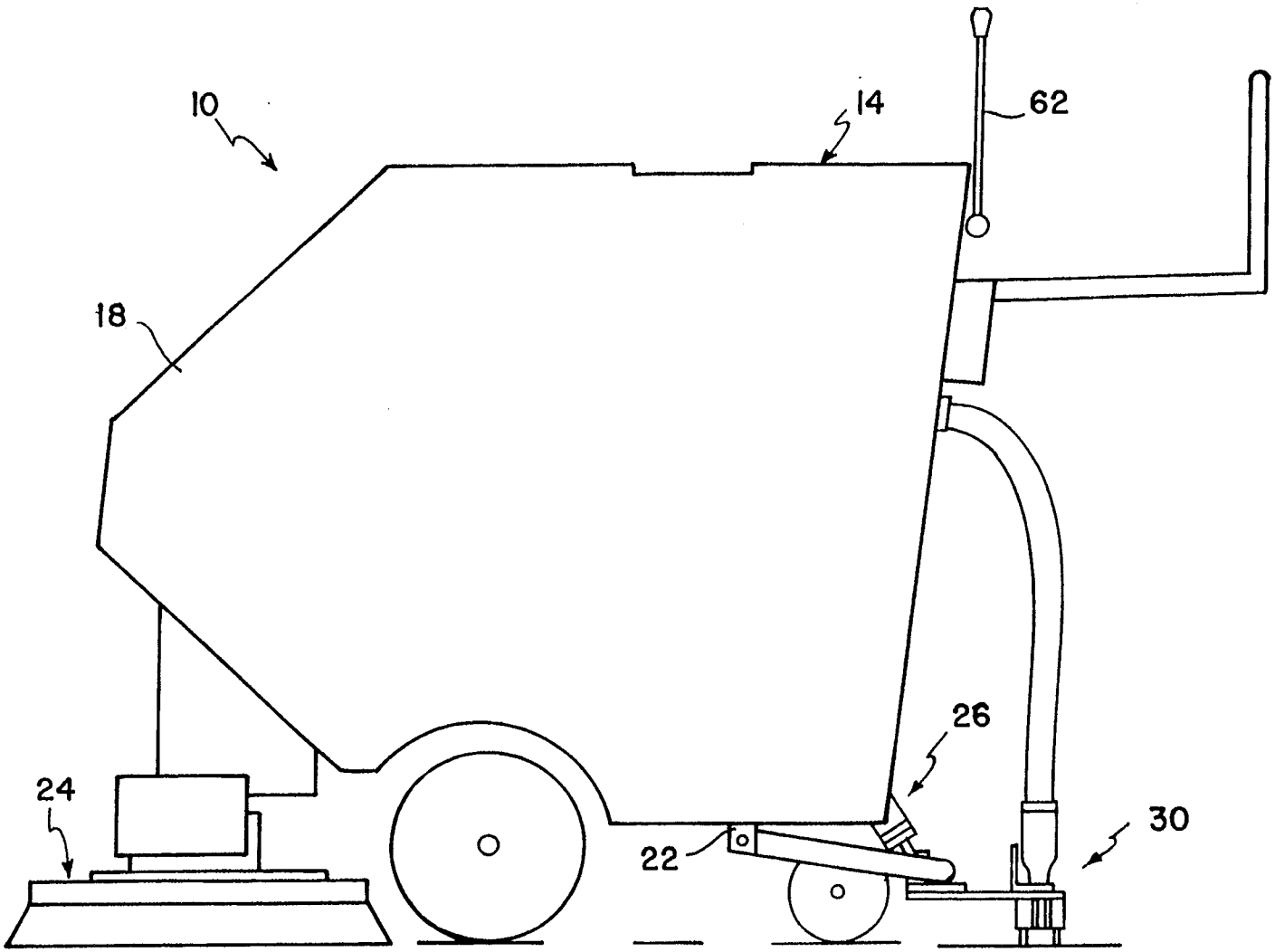
FIG. 1 is a side elevational abbreviated view of a cleaning machine having the squeegee blade assembly of the present invention.

Referring to FIG. 1, a floor cleaning machine 10 is generally represented, which is useful in cleaning the surface of a floor as the machine 10 moves thereacross. The machine 10 includes a housing unit 14 comprising a body 18 and a frame 22 with a scrubbing assembly 24 connected to the housing unit 14. The housing unit 14 contains a number of components (not shown) that are necessary for the operation of the machine 10 and are common to various floor cleaning machines. These components may include, among other items, a clean solution tank for containing the liquid used in cleaning the floor surface, a spent solution tank that receives the liquid from the floor surface that remains after the cleaning step and is picked up by the machine 10, a vacuum motor for drawing the spent liquid into the machine, hoses and/or conduits for carrying liquid, and electrical controls involved in the cleaning operation and movement of the cleaning machine 10.

Figure 2:
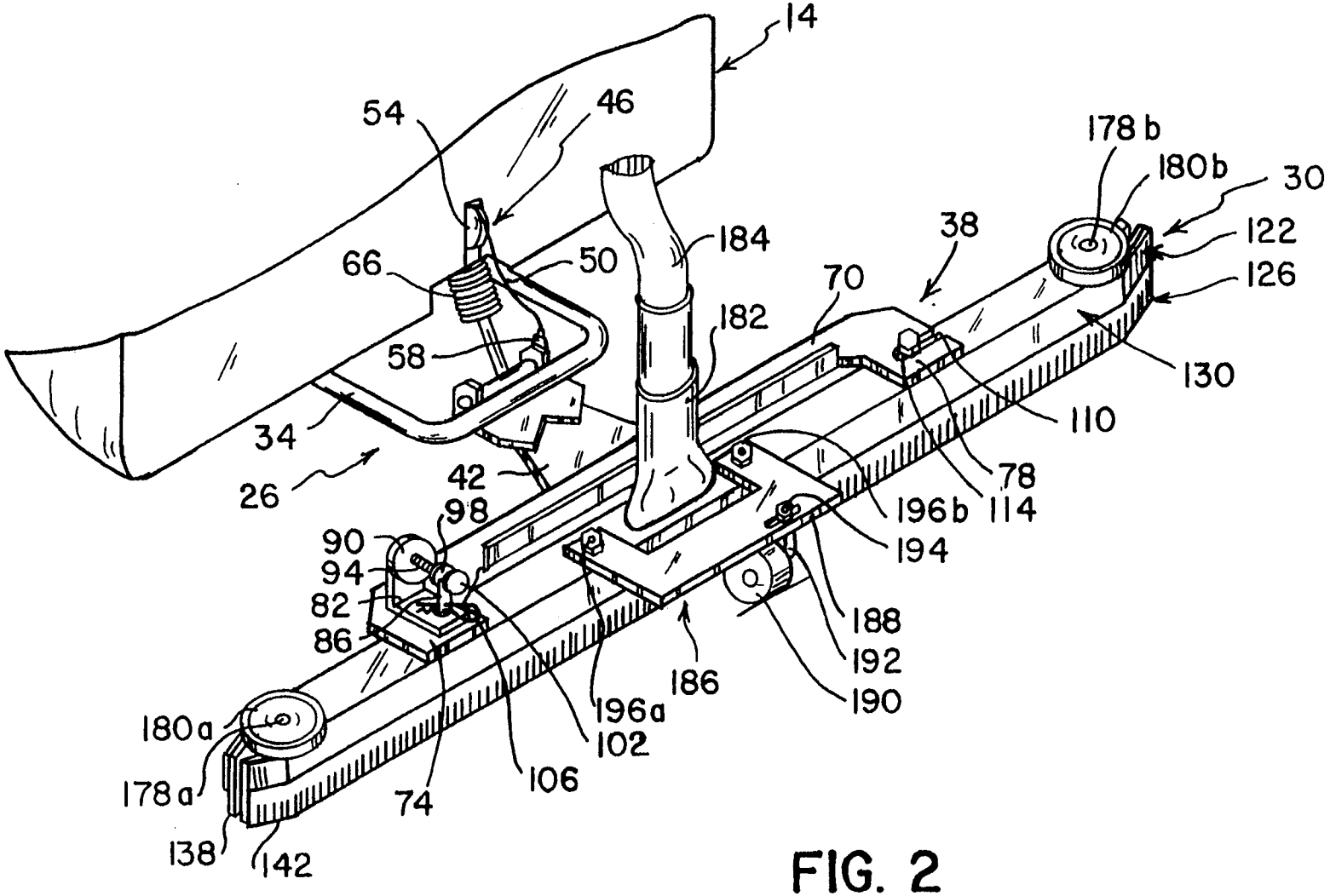
FIG. 2 is a perspective view of the squeegee blade assembly showing its connection to the squeegee mounting assembly.

The cleaning machine 10 also has a squeegee mounting assembly 26 that is used to connect a squeegee assembly 30 to the housing unit 14. As seen in FIG. 2, the mounting assembly 26 comprises a linking member 34 that is joined to a bracket assembly 38 by means of a tongue 42. The bracket assembly 38 is connected to the squeegee assembly 30. The linking member 34 is connected to the housing unit 14 and is used in raising/lowering the squeegee assembly 30. In that regard, portions of a squeegee lifting mechanism 46 are illustrated, with this mechanism including a lifting wire 50 and a pulley 54 along which the lifting wire 50 rides. The free end of the lifting wire 50 is attached to an end terminator 58. The opposite end of the lifting wire 50 is connected to a control lever or handle 62, which is schematically illustrated in FIG. 1. The lifting mechanism 46 also includes a spring member 66. In lifting the squeegee assembly 30 upwardly away from the floor surface, the handle 62 is moved to cause the lifting wire 50 to raise the linking member 34 against the force of the spring member 66. Conversely, when the handle 62 is a moved in a different direction, the lifting wire 50 is released so that the force of the spring member 66 causes the linking member 34 to move downwardly and thereby move the squeegee assembly 30 against the floor surface.

Figure 3:
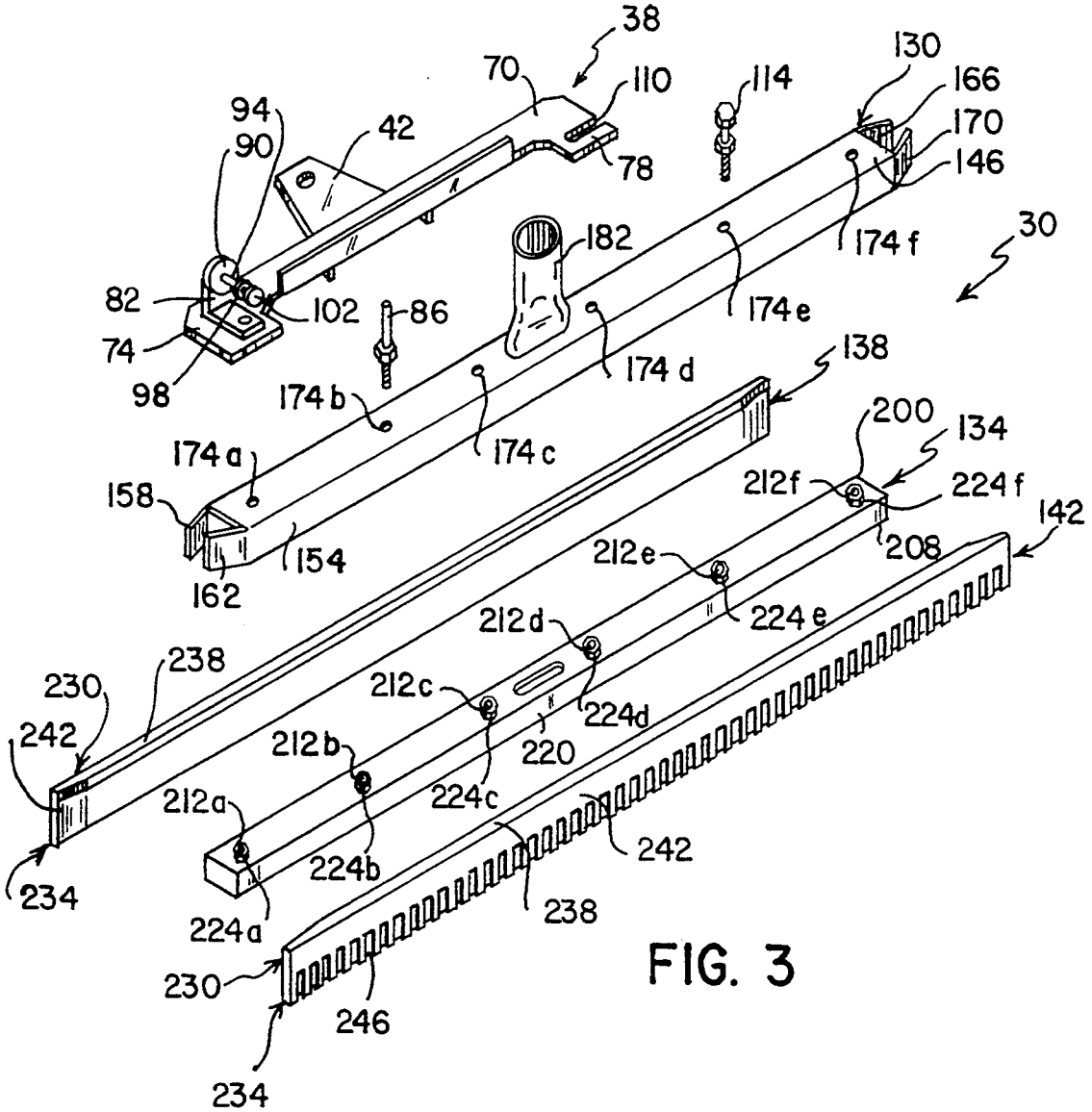
FIG. 3 is an exploded view of the squeegee blade assembly and portions of the squeegee mounting assembly.

With reference to FIG. 3, as well as FIG. 2, the bracket assembly 38 includes a bracket body 70 having a flange 74 located at one end of the bracket body 70 and a web 78 located at the opposite end. In the embodiment illustrated in FIG. 2, the flange 74 is connected to an angle member 82. Each of the flange 74 and the angle member 82 has an aperture aligned with each other. A first mounting connector 86 is located through these two apertures for connecting the angle member 82 and the flange 74 to the squeegee assembly 30. In addition to providing this connection, these parts are also used to achieve a desired position of squeegee blades of the squeegee assembly 30. That is, an adjusting washer 90 is threadably connected to a shaft 94. A pair of stop members 98, 102 are spaced from each other a sufficient distance so that the upper end of the first mounting connector 86 is located therebetween. A cotter pin 106 prevents unwanted outward/upward movement of the angle member 82. In connection with adjusting the angle that the squeegee blades define relative to the floor surface, the securing washer 90 is rotatable along the threaded shaft 94 so that the shaft 94, together with the stop members 98,102 affixed thereto, are movable whereby the top end of the first mounting connector 86 can be caused to tilt off vertical to some slight amount or degree.

Referring again to the bracket body 70, the web 78 has a guide channel 110 for receiving a second mounting connector 114. The head of the second mounting connector 114 has a greater width or diameter than that of the guide channel 110. The second mounting connector 114 is also used in holding the squeegee blades in place.

Figure 4:
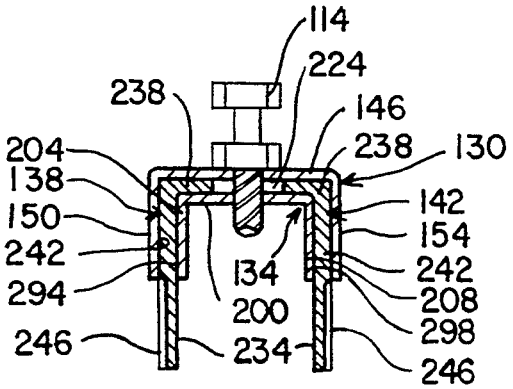
FIG. 4 is a lateral, cross-sectional view illustrating the interconnection and arrangement among the holding subassembly and the squeegee blades including use of the same mounting connectors to connect the squeegee blade assembly to the squeegee mounting assembly and to connect the squeegee blades to the holding subassembly.

With continued reference to FIGS. 2 and 3, the squeegee assembly 30 includes a squeegee holding subassembly 122 and a squeegee blade subassembly 126. The holding subassembly 122 comprises a first contacting shoe 130 and a second contacting shoe 134. The squeegee blade subassembly 126 comprises a first squeegee blade 138 and a second squeegee blade 142. Generally, the second contacting shoe 134 is disposed inwardly relative to the first contacting shoe 130, with the first and second squeegee blades 138,142 positioned therebetween for use in holding the squeegee blade subassembly 126 to the holding subassembly 122, as seen in FIG. 4.

In describing the holding subassembly 122 in greater detail, the first contacting shoe 130 includes an elongated base plate 146 and first and second legs 150, 154. Each of the legs 150, 154 extends downwardly away from the base plate 146 in a direction substantially normal thereto. The combination of the base plate 146 and the first and second legs 150, 154 results in a substantially U-shaped cross-section. The legs 150, 154 are integrally joined to opposite longitudinal extending edges of the base section 146. First and second wing pairs are formed at opposite ends of the length or longitudinal extent of the first and second legs 150, 154. A first wing member 158 is integrally part of the first leg 150 at a first end thereof and a second wing member 162 is integrally part of the second leg 154. The wing members 158, 162 converge towards each other at their free ends. At the opposite ends of the first and second legs 150, 154, a third wing member 166 is integrally part of the first leg 150 and a fourth wing member 170 is integrally part of the second leg 154. The free ends of the wing members 166, 170 also converge toward each other.

The base section 146 also has a number of holes 174. Each of the holes 174 is located at predetermined positions. In the embodiment illustrated, there are six holes **174*a*–174*f* provided in the base section 146. The holes 174*b*, 174*e* are in alignment with the apertures in the angle member 82 and the guide channel 110, respectively. The holes 174*a*, 174*f* at opposite ends of the length of the base section 146 each receives a roller connector 178 to which a roller 180 is joined. The rollers 180*a*, 180*b* are used in preventing contact between wall surfaces and the squeegee assembly 30 since the rollers 180*a*, 180*b* come in contact with these surfaces first and prevent contact with other parts of the squeegee assembly 30**.

Also formed in about the middle of the length of the base section 146 is a slot over which a hose connector 182 is positioned. The hose connector 182 has opened ends, with the end connected to the base section 146 communicating with the slot and the opposite opened end for connection to a hose 184 or the like. The hose 184 communicates with a vacuum source for drawing up spent liquid that is found on the floor surface over which the cleaning machine 10 moves through the hose connector 182.

As also seen in FIG. 2, a caster assembly 186 is connected to the holding subassembly 122. The caster assembly 186 includes a plate 188 to which a caster wheel 190 is attached using a caster shaft 192 and nut 194. The caster plate 188 is connected to the holding subassembly 122 using caster connectors **196*a*, 196*b*. The caster connectors 196*a*, 196*b* are also used in connecting the squeegee blades 138, 142 to the holding subassembly 122. In accomplishing this purpose, the shafts of the connectors 196*a*, 196*b* extend through the holes 174*c*, 174*d* formed in the base section 146**.

With reference to FIGS. 3 and 4, the second contacting shoe 134 comprises an elongated center section 200, together with first and second arms 204, 208 that extend along the length of the center section 200. The first and second arms 204, 208 extend downwardly in a direction substantially normal to the plane of the center section 200. This configuration results in a substantially U-shaped cross-section along the lengths of the integral combination of the first and second legs 204, 208 and center section 200. The center section 200 has bores 212 formed therethrough and spaced from each other along the length of the center section 200. Each of the bores 212 is aligned with one of the holes 174 in the first contacting shoe 130. There are six bores **212*a*–212*f* spaced from each other along the length of the center section 200. When the squeegee subassembly 126 is being held by the holding subassembly 122, with the second contacting shoe 134 being located inwardly of the first contacting shoe 130, the connectors 178*a*, 86, 196*a*, 196*b*, 114, 178*b* are located through the holes 174*a*–174*f*, respectively, and also through the bores 212*a*–212*f*, respectively. A slot 220 is also formed through the center section 200 at about the midportion of the length thereof. The slot 220 is aligned with the hose connector 182 and is provided to receive spent liquid during operation of the squeegee assembly 30. In conjunction with fastening the connectors 178*a* 86, 196*a*, 196*b*, 114, 178*b* to the holding subassembly 122, fasteners 224*a*–224*f*, in the form of nuts, are joined by welding or the like to the center section 200. The fasteners 224*a*–224*f* are threaded for receiving the threaded connectors 178*a*, 86, 196*a*, 196*b*, 114, 178*b***.

Continuing with the description of the squeegee blade subassembly 126, the first and second squeegee blades 138, 142 are identical and interchangeable. Each squeegee blade 138, 142 is characterized as having an upper section 230 and a lower section 234. Each upper section 230 is the part of the squeegee blade 138, 142 that is held between the first and second contacting shoes 130, 134. Each of the upper sections 230 comprises a first or horizontal member 238 and a second or vertical member 242. The horizontal and vertical members 238, 242 define an angle therebetween, which is about 90°. This results in a substantially L-shaped cross-section throughout the length of the first and second squeegee blades 138, 142. The lower sections 234 of each squeegee blade 138, 142 are integrally formed with the upper sections 230, with the free ends of the lower sections 234 for contacting the floor surface during operation of the squeegee assembly 30. The lower sections 234 preferably include a number of slits 246 located along the length thereof to provide a passage for the air and liquid mixture, which passage is necessary in order to pick up the liquid on the floor surface. In a preferred embodiment, the squeegee blades 138,142 are dual durometer blades in which the upper sections 230 have a greater hardness than the lower sections 234. In one embodiment, the hardness of the upper sections 230 are greater than about twice the hardness of the lower sections 234. Preferably, the upper sections 230 have a durometer value of shore A 90 and the lower sections 234 have a durometer value of shore A 40. The harder upper sections 230 enhance and contribute to holding the squeegee blades 138, 142 between the first and second contacting shoes 130, 134 while the less hard lower portions 234 enhance and contribute to the desired resiliency of those portions of the squeegee blades 138, 142 that contact the floor surface in connection with the wiping up of spent liquid and removal of thin films of liquid as the cleaning machine 10 moves across the floor surface.

In describing in greater detail the interconnection among the parts of the squeegee assembly 30 and its connection to the squeegee mounting assembly 26, continued reference is made to FIGS. 2 and 4. As illustrated in FIG. 4, the upper sections 230 are located between the first and second contacting shoes 130, 134. More particularly, the first or horizontal members 238 of the upper sections 230 occupy a space between the inner surface of the base plate and the outer surface of the center section 200. The lengths or extents of the first or horizontal members 238 are sufficient so that they butt up against the outer diameters of the fasteners 224. At the least, the lengths of the horizontal members 238 are less than a length that would overlie the bores 212 and prevent the connectors **86, 114, 178*a*, 178*b*, 196*a*, 196*b* from being received therethrough. The vertical members 242 of the upper sections 230 extend between the inner surface of the legs 150, 154 and the outer surfaces of the arms 294, 298. The lower sections 234 of the blades 138, 142** are not positioned between the legs and the arms, but extend outwardly therefrom.

In conjunction with fixedly holding the squeegee blades 138, 142 in place by means of the holding subassembly 122, the connectors **86, 114, 178*a*, 178*b*, 196*a*, 196*b* are threadably located through the base plate holes 174 and center section bores 212. This arrangement tightly interconnects the first and second contacting shoes 130, 134 by creating a compressive force in a direction substantially parallel to the length of the connectors 86, 114, 178*a*, 178*b*, 196*a*, 196*b*. Any tendency of the squeegee blades 138, 142 to be pulled from the holding subassembly 122, as a result of forceful engagement between the free ends of the lower sections 234 and the floor surface, is sufficiently resisted by the holding or clamping action due to this compressive force acting on the horizontal members 238 of the squeegee blade upper sections 230. A second compressive force is provided along the second or vertical members 242 of the upper sections 230 due to the interconnection between the first and second contacting shoes 130, 134 together with the tight or close fitting achieved by the dimensions and arrangement among the legs and arms of the contacting shoes, as well as that of the vertical members 242. In the absence, however, of the first or horizontal members 238 positioned between the base plate 146 and center section 200, it is not likely that the squeegee blades 138, 142 would be properly held in place and/or optimally function. That is, the second compressive force involving the arms and legs of the contacting shoes sandwiching the vertical members 242 in a direction substantially perpendicular to the length of the connectors 86, 114, 178*a*, 178*b*, 196*a*, 196*b* would not be sufficient to hold the squeegee blades 138, 142** in place during their wiping action.

With respect to the assembly/disassembly of the squeegee blade assembly 30, particularly replacement or interchange of the squeegee blades 138, 142, the bracket assembly 38 is disconnected from the squeegee assembly 30 by removing the cotter pin 106 from the first mounting connector 86 and then lifting the flange 74 upwardly away from the holding subassembly 122. The web 78 is then moved in a leftward direction, with reference to FIG. 2, so that the guide channel 110 is moved by and away from the second mounting connector 114. This disconnection results in the squeegee blade assembly 30 being detached from the housing unit 14. After this, each of the connectors **86, 114,178*a*, 178*b*, 196*a*, 196*b* is untightened. The user or operator of the cleaning machine 10 is then able to separate the first and second contacting shoes 130, 134 from each other and also remove the squeegee blades 138, 142. After removal, the squeegee blades 138, 142 can be replaced with new squeegee blades or interchanged or, perhaps, only one of the two squeegee blades needs to be replaced. After any appropriate change of squeegee blades, the upper sections 230 thereof can be positioned adjacent the inner surfaces of the first contacting shoe 130 and then the second contacting shoe 74 can be located inwardly. The holding subassembly 122 and the squeegee blade subassembly 126 are then connected together by means of the connectors, with these connectors also connecting the squeegee mounting assembly 26, rollers 178*a*, 178*b* and caster assembly 186 to the squeegee assembly 30**.

The foregoing discussion of the invention has been presented for purposes of illustration and description. Further, the description is not intended to limit the invention to the form disclosed herein. Consequently, variation and modification commensurate with the above teachings, within the skill and knowledge of the relevant art, are within the scope of the present invention. The embodiment described hereinabove is further intended to explain the best mode presently known of practicing the invention and to enable others skilled in the art to utilize the invention in such, or in other embodiments, and with the various modifications required by their particular application or uses of the invention. It is intended that the appended claims be construed to include alternative embodiments to the extent permitted by the prior art.

What is claimed is:

1. A cleaning machine for use in cleaning a surface, comprising:

a housing unit for containing a number of cleaning machine components;

a cleaning assembly connected to said housing unit for cleaning a path on a floor surface;

machine moving means for use in moving said housing unit and said cleaning assembly;

a squeegee mounting assembly connected to said housing unit;

a squeegee assembly separate from but connected to said squeegee mounting assembly for wiping up liquid on the floor surface, said squeegee assembly including:

(1A) squeegee blade means for collecting liquid from the floor surface, and (1B) a blade holding subassembly;

said squeegee blade means including at least a first squeegee blade having upper and lower sections, said lower section including a laterally extending edge for contacting the floor surface when collecting liquid, said upper surface joined to said lower section above said laterally extending edge, wherein said blade holding subassembly fixedly holds said upper section of said first squeegee blade in place, said blade holding subassembly including a plurality of connectors positioned through portions of said blade holding subassembly, each of said plurality of connectors being for holding said first squeegee blade, and wherein said plurality of connectors includes roller connectors for connecting rollers, located adjacent to ends of said holding subassembly, to said blade holding subassembly.

2. A machine, as claimed in claim 1, wherein:

said squeegee blade means includes a second squeegee blade, separate from said first squeegee blade, with each of said first and second squeegee blades having a generally L-shaped lateral cross-section.

3. A machine, as claimed in claim 1, wherein:

said holding subassembly includes a first contacting shoe and a second contacting shoe, said upper section of said first squeegee blade includes first and second members, with said first member being at an angle relative to said second member.

4. A machine, as claimed in claim 1, wherein:

a first compressive force, supplied by an engagement of at least a first connector of said plurality of connectors with said holding subassembly, acts on said first squeegee blade to maintain said first squeegee blade in position, said first compressive force being in a direction substantially parallel to a length of said first connector.

5. A machine, as claimed in claim 4 wherein:

a second compressive force acts on said first squeegee blade in a direction substantially perpendicular to said length of said first connector, said second compressive force supplied by fitting said first squeegee blade between a first contacting shoe means and a second contacting shoe means such that said first and second contacting shoe means fixedly hold said upper section of said first squeeze blade in place.

6. A machine, as claimed in claim 1, wherein:

said squeegee blade means includes a separate second squeegee blades with said second squeegee blade also having an upper section held substantially fixed in place using said holding subassembly, said second squeegee blade also having a lower section to which said upper section of said second squeegee blade is joined, said lower section of said second squeegee blade extending outwardly from said upper section of said second squeegee blade, at least one of said upper sections of said first and second squeegee blades being a first upper section wherein said first upper section is made of a material having a hardness different from said lower section to which said first upper section is joined, wherein said first upper section is more hard than said lower section to which said first upper section is joined.

7. A machine, as claimed in claim 6, wherein:

said first upper section has a durometer value of about shore A 90 and said lower section to which said first upper section is joined has a durometer value of about shore A 40.

8. A machine, as claimed in claim 7, wherein:

said first upper section and said lower section to which said first upper section is joined are integrally formed as a single piece member.

9. A machine, as claimed in claim 1, wherein:

said holding subassembly includes a first contacting shoe and a second contacting shoe, said first contacting shoe has a base plate and first and second legs connected to opposite edges of said base plate, said second contacting shoe has a center section and first and second arms connected to opposite edges of said center section, wherein a horizontal member of said upper section of said first squeegee blade is clamped between said base plate and said center section.

10. A machine, as claimed in claim 9, wherein:

a space is defined between said base plate and said center section with at least some of said space being occupied by said horizontal member of said squeegee blade means.

11. A machine, as claimed in claim 1, wherein:

said holding subassembly includes a first contacting shoe and a second contacting shoe, said second contacting shoe being located inwardly relative to said first contacting shoe, said second contacting shoe comprising a center section having at least a first bore therethrough, with portions of said upper section of said first squeegee blade contacting said center section and said portions being adjacent to said first bore.

12. A machine, as claimed in claim 11, wherein:

said holding subassembly includes a first fastener joined to said center section and axially aligned with said first bore, said first fastener receiving a first of said connectors for use in clamping said portions of said first squeegee blade to said center section and also for connecting said squeegee mounting assembly to said holding subassembly.

13. A machine, as claimed in claim 11, wherein:

said first contacting shoe includes a base plate having at least a first hole, said first hole being aligned with said first bore, wherein said first connector is connected to said squeegee mounting assembly while being positioned through said first hole and said first bore.

14. A machine, as claimed in claim 1, wherein:

said squeegee mounting assembly includes a bracket body having a flange and a web and overlying said holding subassembly.

15. A cleaning machine for use in cleaning a surface, comprising:

a housing unit for containing a number of cleaning machine components;

a cleaning assembly connected to said housing unit for cleaning a path on a floor surface;

machine moving means for use in moving said housing unit and said cleaning assembly;

a squeegee mounting assembly connected to said housing unit;

a squeegee assembly separate from but connected to said squeegee mounting assembly for wiping up liquid on the floor surface, said squeegee assembly including:

(1A) squeegee blade means for collecting liquid from the floor surface, and (1B) a blade holding subassembly;

said squeegee blade means including at least a first squeegee blade having upper and lower sections, said lower section including a laterally extending edge for contacting the floor surface when collecting liquid, said upper section joined to said lower section above said laterally extending edge, wherein said blade holding subassembly fixedly holds said upper section of said first squeegee blade in place, said blade holding subassembly including a plurality of connectors positioned through portions of said blade holding subassembly, each of said plurality of connectors being for holding said first squeegee blade, and wherein said plurality of connectors includes a connector for connecting a caster assembly to said blade holding subassembly.

16. A cleaning machine for use in cleaning a surface, comprising:

a housing unit for containing a number of cleaning machine components;

a cleaning assembly connected to said housing unit for cleaning a path on a floor surface;

machine moving means for use in moving said housing unit and said cleaning assembly;

a squeegee mounting assembly connected to said housing unit;

a squeegee assembly separate from but connected to said squeegee mounting assembly for wiping up liquid on the floor surface, said squeegee assembly including:

(1A) squeegee blade means for collecting liquid from the floor surface, and (2B) a blade holding subassembly;

said squeegee blade means including at least a first squeegee blade having upper and lower sections, said lower section including a laterally extending edge for contacting the floor surface when collecting liquid, said upper section joined to said lower section above said laterally extending edge, wherein said blade holding subassembly fixedly holds said upper section of said first squeegee blade in place, said blade holding subassembly including a plurality of connectors positioned through portions of said blade holding subassembly, each of said plurality of connectors being for holding said first squeegee blade, and wherein said plurality of connectors includes a connector for connecting said squeegee mounting assembly to said blade holding subassembly.

* * * * *